US006732025B2

(12) United States Patent
Reese, II et al.

(10) Patent No.: US 6,732,025 B2
(45) Date of Patent: May 4, 2004

(54) ENGINE WARM-UP MODEL AND THERMOSTAT RATIONALITY DIAGNOSTIC

(75) Inventors: Ronald A Reese, II, Goodrich, MI (US); Gary M Pallach, Chesterfield, MI (US); Gary D. Dawson, Rochester, MI (US); David P. Ploucha, Ann Arbor, MI (US); Susan A. Aldridge, Linden, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 81 days.

(21) Appl. No.: 10/118,505

(22) Filed: Apr. 8, 2002

(65) Prior Publication Data

US 2002/0193921 A1 Dec. 19, 2002

Related U.S. Application Data

(63) Continuation-in-part of application No. 09/732,995, filed on Dec. 8, 2000.

(51) Int. Cl.[7] ..... G01M 17/00

(52) U.S. Cl. ..... 701/29

(58) Field of Search ..... 701/29, 34, 36, 701/101–106, 112–114; 73/116, 117.3, 118.1, 119 R; 123/41.01; 340/449, 450, 450.2, 450.3

(56) References Cited

U.S. PATENT DOCUMENTS 6,200,021 B1 * 3/2001 Mitsutani et al. ..... 374/1
6,240,774 B1 * 6/2001 Niki et al. ..... 73/118.1
6,302,065 B1 * 10/2001 Davison ..... 123/41.15

* cited by examiner

*Primary Examiner*—Thu V. Nguyen
(74) *Attorney, Agent, or Firm*—Edwin W. Bacon, Jr.

(57) ABSTRACT

A method is provided for testing a thermostat in a motor vehicle. The method includes an engine warm-up model and a thermostat diagnostic. The engine warm-up model predicts the temperature that the engine coolant temperature should be equal to at a given time after start-up. This is based on the engine coolant temperature at start-up, ambient air temperature, and how the vehicle is driven subsequent to start-up. This predicted engine coolant temperature is compared to the actual engine coolant temperature as read by an engine coolant temperature sensor. The error between the predicted engine coolant temperature and the actual engine coolant temperature is calculated and integrated over time. The thermostat diagnostic runs at a pre-selected temperature after start-up and compares the integrated error to a predetermined threshold value. Depending upon the results of the comparison, a pass, fail, or inconclusive condition is determined.

24 Claims, 8 Drawing Sheets

ENGINE WARM-UP MODEL AND THERMOSTAT RATIONALITY DIAGNOSTIC

CROSS REFERENCE TO RELATED APPLICATION

This application is a continuation-in-part of U.S. patent application Ser. No. 09/732,995, filed Dec. 8, 2000, the entire disclosure of the application is considered part of the disclosure of this application and is hereby incorporated by reference.

FIELD OF THE INVENTION

The present invention relates generally to on board diagnostic systems for motor vehicles, and more particularly to a method for determining whether a thermostat in a motor vehicle is operating properly.

BACKGROUND OF THE INVENTION

An on board diagnostic system is an emissions diagnostic system whose purpose is to monitor all systems and components in a vehicle that can affect emissions and to inform the driver of that vehicle when an emissions-related problem has occurred. An emissions-related problem is detected when either a system or a deterioration of a system (or component thereof) causes vehicle emissions to exceed certain pre-selected thresholds. On board diagnostics are currently employed in passenger cars, light-duty trucks, and medium-duty vehicles in all 50 states and Canada and are quickly becoming used worldwide.

Generally, on board diagnostics check current operating conditions against enable conditions to determine if any monitoring program should run. If enabled, the monitoring program performs calculations based on certain sensor information and other related variables. The resulting diagnostic parameters are then checked against calibrated threshold values. These threshold values are typically correlated to emissions performance through standardized test procedures. If the resulting diagnostic parameters are less than the calibrated threshold values, then a pass status is processed. If the resulting diagnostic parameters are greater than the thresholds, then a fail status may be processed. The on board diagnostics system typically processes a failure by illuminating the "Check Engine" malfunction indicator lamp on the instrument panel and stores a fault code in the powertrain controller for later retrieval by a service technician.

Although many vehicle system components are monitored by way of conventional on board diagnostic systems, there is no diagnostic which monitors whether the thermostat of a motor vehicle is operating properly. Accordingly, it would be desirable to provide an on board diagnostic for determining whether a thermostat in a motor vehicle is operating properly.

SUMMARY OF THE INVENTION

The above and other objects are provided by a method which includes an engine warm-up model and a thermostat diagnostic. The engine warm-up model predicts an engine coolant temperature at a given time after start-up. This is based on the engine coolant temperature at start-up, ambient air temperature, and how the vehicle is driven subsequent to start-up. This predicted engine coolant temperature is compared to the actual engine coolant temperature as read by an engine coolant temperature sensor. The error between the predicted engine coolant temperature and the actual engine coolant temperature is calculated and integrated over time.

The thermostat diagnostic runs at a pre-selected time after start-up when the engine coolant temperature is above a threshold temperature and compares the integrated error to a predetermined threshold value. Depending upon the results of the comparison, a pass, fail, or inconclusive condition is determined.

The predetermined threshold value is calculated to discern between a properly operating thermostat operating in a vehicle which is experiencing the maximum heat loss/minimum heat gain possible and an improperly operating thermostat operating in a vehicle which is experiencing the minimum heat loss/maximum heat gain possible. The properly operating thermostat/maximum heat loss/minimum heat gain scenario provides the slowest possible engine coolant temperature warm-up for a vehicle with a properly operating thermostat. Conversely, the improperly operating thermostat/minimum heat loss/maximum heat gain scenario provides the fastest possible engine coolant temperature warm-up for a vehicle with an improperly operating thermostat.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
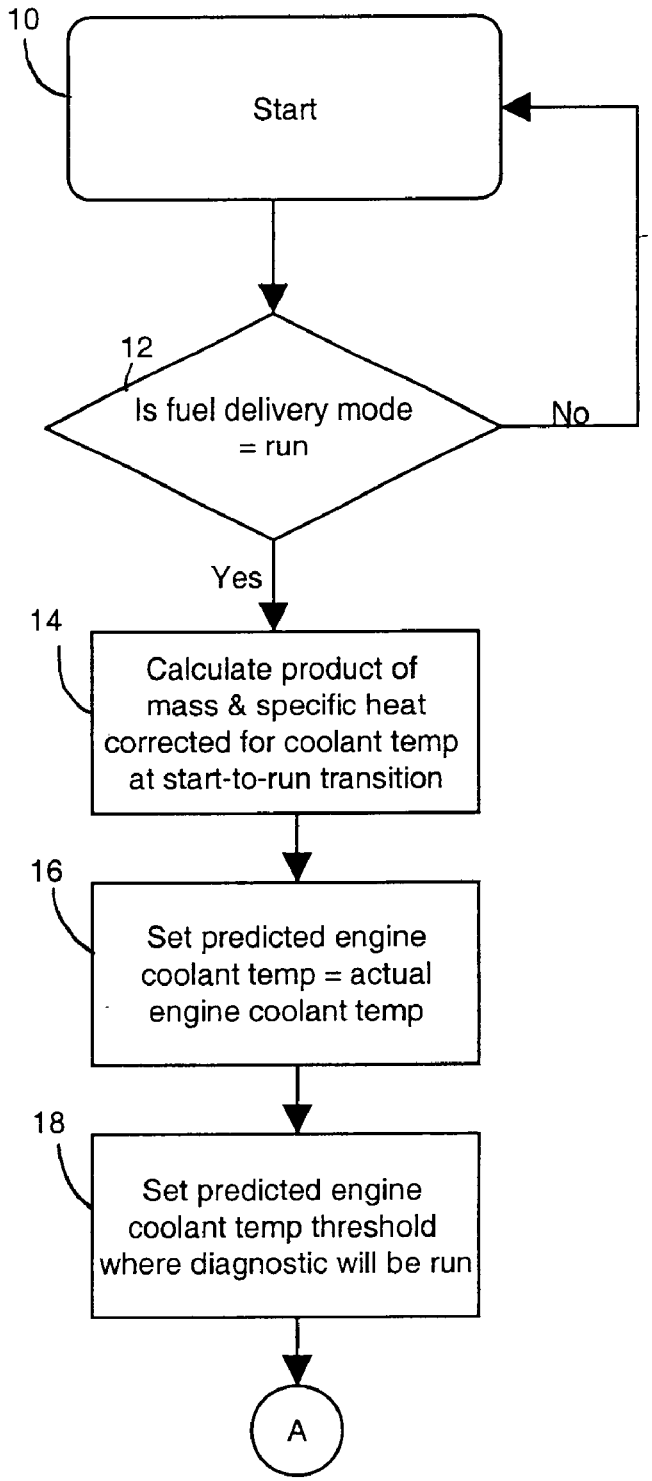
FIG. 1 is a flowchart depicting the enabling criteria and initialization of the engine warm-up model and diagnostic methodology of the present invention.

The present invention is directed towards a method for determining whether a thermostat in a motor vehicle is operating properly. The method includes an engine warm-up model for predicting what the engine coolant temperature of the motor vehicle should be at a given time of operation and a thermostat diagnostic which determines whether the thermostat is operating properly based on a comparison between the predicted engine coolant temperature from the engine warm-up model and the actual engine coolant temperature. The following description of the invention will be supplemented with a description of the drawings below.

First, the engine warm-up model will be described. The engine warm-up model is based on a first-order thermal system. The basic law employed is the conservation of energy:

$$q_{in}-q_{out}=q_{stored}$$

The energy in term ($q_{in}$) accounts for the amount of heat rejected to the engine coolant by the engine due to the combustion process and friction. The energy out term ($q_{out}$) includes factors that may cause the coolant to lose some of the heat gained including convection from the engine to ambient air and through the motor vehicle heater. The energy stored term ($q_{stored}$) treats the engine as a single lumped parameter (i.e., solids and liquids) thereby accounting for the increase in temperature of the coolant.

The energy in term, or heat gain, is based on a mapped heat rejection surface produced during engine dynamometer heat rejection tests. To acquire the heat gain term at any given time during testing, normalized fuel mass flow rate and engine speed are used as the input parameters to the heat rejection surface. The normalized fuel mass flow rate and engine speed are accumulated between executions of the test and averaged during each execution to account for rapid changes that may occur, such as deceleration fuel shut-off. A correction to the heat gain term is made to account for differences between the actual fuel-to-air ratio, charge air temperature (ACT) and the predicted coolant temperature and the fuel-to-air ratio, charge air temperature and coolant temperature existing during the engine dynamometer heat rejection tests.

The correction to the heat gain term is a ratio of temperature differences. The difference is the derived "mean combustion gas temperature" ($T_g$) minus engine coolant temperature. The mean combustion gas temperature is modeled as function of the fuel-to-air ratio based on a curve developed by Taylor in *The Internal Combustion Engine in Theory and Practice*, the M.I.T. Press, 1986. The numerator of the ratio includes the actual values for each parameter and accounts for differences in the charge air temperature, while the denominator includes the values from the dynamometer testing. The corrected energy in or heat gain term is determined by the following equation:

$$q_{gain,corr} = q_{gain,dyno} * \left\{ \frac{\{T_g(FA_{act}) + [T_{chrgair,act} - T_{chrgair,dyno}] * C_1\} - T_{c,pred}}{T_g(FA_{dyno}) - T_{c,dyno}} \right\}$$

wherein $q_{gain,corr}$=the dynamometer heat rejection value corrected for equivalence (fuel-to-air) ratio, dynamometer engine coolant temperature, dynamometer ambient air, and current charge air temperature:

$q_{gain,dyno}$=a selected value from a table of heat rejection values obtained from the dynamometer heat rejection testing;

$T_g(FA_{act})$=a selected value from a mean combustion gas temperature lookup table for making corrections to heat gain as a function of actual fuel-to-air ratio;

$T_g(FA_{dyno})$=a selected value from a mean combustion gas temperature lookup table for making corrections to heat gain as a function of dyno fuel-to-air ratio;

$T_{chrgair,act}$=the actual charge air temperature;

$T_{chrgair,dyno}$=the ambient air temperature at which the dynamometer heat rejection data set was obtained;

$C_1$=a multiplier of the difference between charge air temperature and the ambient air temperature at which the dynamometer heat rejection data set was obtained which yields the combustion gas temperature offset;

$T_{c,pred}$=the engine coolant temperature predicted by the model; and $T_{c,dyno}$=the engine coolant temperature at which the dynamometer heat rejection data set was obtained.

Testing has shown that there is a significant and consistent time delay between the start of a vehicle and the initial response of the engine coolant temperature sensor. This delay is attributed to the time it takes to heat the solid block/head of the engine and the liquid coolant/oil of the engine. This affect is accounted for by delaying the transfer of heat to the coolant by one of two methods: delay until the engine coolant temperature reaches a calibratable offset above the initial predicted engine coolant temperature (which is set equal to the actual engine coolant temperature after the start-to-run transition); or delay until a maximum calibrated amount of time equal to the time it takes before the coolant temperature responds to heat input after the fuel delivery mode transitions from start-to-run. The heat gain term used by subsequent calculations is the delayed value which equals the dynamometer heat rejection corrected for fuel-to-air ratio, dynamometer engine coolant temperature, dynamometer ambient air, and current charge air temperature.

The energy out term, or heat loss, within the method is modeled separately by the equation for Newton's Law of Cooling:

$$q_{loss}=h*A*\Delta T$$

wherein $q_{loss}$=convention heat loss;

h=convection heat transfer coefficient;

A=nominal heat transfer surface area; and

ΔT=temperature difference.

Heat loss from the coolant by convection to the ambient air is dependent upon air velocity through the engine compartment. Vehicle speed is used as a surrogate for air velocity. Vehicle speed is normalized to 100 mph to make the value dimensionless, raised to a power, and scaled to achieve the heat transfer coefficient due to forced convection. Heat loss to the ambient air due to natural convection is accounted for in the additive term of the equation for the heat transfer coefficient as shown in the equation below:

$$q_{loss,amb} = \left\{C_2 * \left[\frac{V}{100\ \text{mph}}\right]^n + C_3\right\} * A_{amb} * [T_{c,pred} - T_{amb}] = \{C_2 * (V_{norm})^n + C_3\} * A_{amb} * [T_{c,pred} - T_{amb}]$$

wherein $q_{loss,amb}$=the heat loss to ambient air based on vehicle speed in miles per hour;

$C_2$=the coefficient for ambient heat loss (heat transfer coefficient), the value of A in the equation, h=A*(vehicle speed/100)$^n$+B;

$C_3$=offset for ambient heat loss heat transfer coefficient, the value of B in the equation h=A*(vehicle speed/100)$^n$+B;

V=vehicle speed in miles per hour;

$(V_{norm})^n$=the value from an ambient air exponent lookup table for heat transfer coefficients as a function of vehicle speed, the value of (vehicle speed/100)$^n$ in the equation, h=A* (vehicle speed/100)$^n$+B;

$A_{amb}$=the estimated area of engine surfaces which contribute to convection heat losses to ambient air;

$T_{c,pred}$=the engine coolant temperature predicted by the model; and $T_{amb}$=ambient air temperature used for the system.

Heat loss from the coolant through the passenger compartment heater is dependent on the coolant flow rate through the heater core. Engine speed is used as a surrogate for coolant flow rate. Engine speed is normalized to 1,000 rpm to make the value dimensionless, raised to a power, and scaled to achieve the heat transfer coefficient due to forced convection. In the model, air flow across the heater core is assumed to be at its maximum value (high blower/bi-level mode/full heat). The heater inlet air temperature is taken as the ambient temperature when the air conditioning system is off. However, the heater inlet air temperature can be set to a predetermined value when the air conditioner is operating. The equation for calculating the heat loss through the heater is shown below:

$$q_{loss,htr} = \left\{C_4 * \left[\frac{N}{1000\ \text{rpm}}\right]^n\right\} * A_{htr} * [T_{c,pred} - T_{htr,in}]$$
$$= \{C_4 * (N_{norm})^n\} * A_{htr} * [T_{c,pred} - T_{htr,in}]$$

wherein $q_{loss,htr}$=the heat loss through the passenger compartment heater based on engine speed;

$C_4$=a coefficient for passenger compartment (heater core) heat loss (heat transfer coefficient), the value of A in the equation h=A*(engine speed/1,000)$^n$;

N=average vehicle engine speed;

$(N_{norm})^n$=a value from a heater exponent lookup table for heat transfer coefficients as a function of engine speed, the value of (engine speed/1,000)$^n$ in the equation h=A*(engine speed/1,000)$^n$;

$A_{htr}$=the estimated area of the heater core (the heat transfer surface) which contributes to convection heat losses to the passenger compartment;

$T_{c,pred}$=the engine coolant temperature predicted by the model; and $T_{htr,in}$=the temperature of the air entering the heater.

The energy balance equation is then solved to determine the energy (or heat) stored in the lumped-mass engine system (engine solid and engine fluids). This is done by subtracting the heat loss term from the heat gain term. The value for the stored heat is divided by the product of the mass (m) and specific heat (Cp) of the engine and integrated with respect to time to obtain the temperature change. The value of the integral is added to the initial coolant temperature (i.e., when the engine is started) to determine the predicted coolant temperature. Thus:

$$q_{stored} = m * Cp * \frac{dT}{dt}$$

$$q_{gain,corr,dly} - q_{loss,amb} - q_{loss,htr} = (mCp)_{corr} * \frac{dT}{dt}$$

$$T_{c,pred} = T_{c,act_{initial}} + \int \frac{q_{gain,corr,dly} - q_{loss,amb} - q_{loss,htr}}{(mCp)_{corr}} dt$$

wherein $T_{c,pred}$=the engine coolant temperature predicted by the model;

$T_{c,act,initial}$=the engine coolant temperature at the initial start-to-run transition;

$q_{gain,corr,dly}$=the dynamometer heat rejection value corrected for fuel-to-air ratio, dynamometer engine coolant temperature, dynamometer ambient air, and current charge air temperature after the delay time it takes before the coolant temperature responds to heat input after startup;

$q_{loss,amb}$=the heat loss to ambient air based on vehicle speed;

$q_{loss,htr}$=the heat loss through the passenger compartment heater based on engine speed;

$(mCp)_{corr}$=the mass and specific heat product of the engine mass corrected for the engine coolant temperature at startup.

The product of the mass and specific heat is derived from the system time constant which relates it to the ambient heat loss term. This product is corrected as a function of the starting coolant temperature to account for changes in specific heat. Testing has shown that using the starting coolant temperature yields more accurate results than the instantaneous temperature. This is believed to be due in part to the fact that the system is modeled as a single mass. The equation for the correction to the mass and specific heat is indicated below:

$$(mCp)_{corr}=(mCp)_{std}*\{C_5*(T_{c,act_{initial}}-T_{Cp,std})+1\}$$

wherein $(mCp)_{corr}$=the mass and specific heat product of the engine corrected for startup engine coolant temperature;

$(mCp)_{std}$=a reference value of the mCp product at standard conditions, the value of A in the equation, mCp=A*(B* (startup engine coolant temperature−C)+1);

$C_5$=a correction multiplier to account for changes in the specific heat of the engine surfaces as a function of temperature, the value of B in the equation, mCp=A*(B*(startup engine coolant temperature−C)+1);

$T_{c,act,initial}$=the engine coolant temperature at the initial start-to-run transition; and $T_{Cp,std}$=the standard temperature of the specific heat value, the value of C in the equation, mCp=A*(B*(startup engine coolant temperature−C)+1).

Next, the thermostat diagnostic feature of the present invention will be described. After the heat gain delay has been achieved, the error between the predicted engine coolant temperature and the actual engine coolant temperature is integrated with respect to time. This integrated error is compared to error thresholds to determine whether the thermostat is operating properly or improperly.

Vehicles with properly operating thermostats yield integrated errors greater than the pass threshold. Vehicles with improperly operating thermostats yield integrated errors less than the fail threshold. Separate pass and fail thresholds are calibrated in order to improve the accuracy of the diagnostic (i.e., minimize α and β errors). As is known, α and β errors are conditions which might indicate good thermostat when, in fact it is bad, and conditions which might indicate a bad thermostat when, in fact it is good, respectively. This results in a system tolerance range where otherwise valid trips that neither pass nor fail are deemed inconclusive.

The thermostat diagnostic feature also determines at what point during the trip the test should be performed. Extensive testing and evaluation have found that performing the test at a fixed predicted coolant temperature change from the starting temperature provides reliable results. The maximum coolant temperature at which the test occurs is limited to prevent the interaction of an operating thermostat. The logic for selecting the desired predicted coolant temperature at which to perform the test is shown below:

$$(T_{c,pred})_{run}=\text{the minimum of } \{(T_{c,pred})_{max} \text{ or } T_{c,initial}+(T_{c,pred})_{offset}\}$$

wherein $(T_{c,pred})_{run}$=the threshhold for the predicted engine coolant temperature where the diagnostic test will run;

$(T_{c,pred})_{max}$=the maximum predicted engine coolant temperature that the diagnostic will run;

$(T_{c,pred})_{offset}$=the offset temperature applied to ambient coolant temperature at which the diagnostic will run; and $T_{c,initial}$=the engine collant temperature at initial start-to-run transition.

If the actual engine coolant temperature attains a calibrated value before the predicted coolant temperature reaches the test temperature, the test concludes that the vehicle has a properly functioning thermostat. The calibrated value is set equal to, for example, an engine coolant temperature pass threshold as prescribed by an industry or government prescribed standard, i.e., within 20 degrees of the thermostat opening temperature.

The pass and fail thresholds are calibrated as a function of ambient air temperature to account for the lower integrated errors incurred when the coolant temperature increase during the trip is limited by the maximum coolant temperature at which the test should be performed. The pass threshold is defined in a predetermined value (the value of the lowest integrated error required to pass the test). Similarly, the fail threshold is defined in a predetermined value (the value of the highest integrated error required to fail the test). The difference between the actual integrated error and the applicable threshold is reported as the difference between the pass or fail threshold and the actual integrated error.

Several factors may prevent the warm-up model from accurately predicting the coolant temperature and therefor affect the integrity of the thermostat rationality feature. The diagnostic checks for these conditions and will neither pass nor fail a test if one of the conditions exist. The existence of each condition causes an internal bit to be set to designate the cause of the "no test" circumstance. These conditions, for example, include a high starting ambient temperature, a low starting ambient temperature, an insufficient soak temperature, a low average vehicle speed, and an inconclusive error.

A trip conducted at a high ambient temperature (and therefor high starting coolant temperature) does not allow the model to run long enough to adequately accumulate error between the predicted and actual coolant temperatures. The predetermined variable to check against for this condition is the maximum ambient temperature for the test to run. This could be, for example, 100–110 degrees Fahrenheit. The internal bit set if this condition exists is a flag to show the diagnostic test was aborted due to the ambient temperature being too high.

The accuracy of the warm-up model may be compromised at extremely low temperatures. To account for this, a low temperature disable is provided. The predetermined variable to check against for this condition is the minimum ambient temperature for the test to run. This could be, for example, −10 to 20 degrees Fahrenheit. The internal bit set if the condition exists is a flag to show the diagnostic test was aborted due to the ambient temperature being too low.

A large temperature difference between the starting coolant temperature and the ambient air temperature may indicate that the vehicle has not had an adequate cold soak and therefore may prevent the warm-up model from providing an accurate prediction of the engine coolant temperature. The predetermined value to check against for this condition is the difference in temperature between the ambient temperature and the engine coolant temperature at start-up. This could be, for example, 5–15 degrees Fahrenheit. The internal bit set if the condition exists is a flag to show the diagnostic test was aborted due to an inadequate thermal soak of the vehicle.

Low vehicle speed conditions produce nearly the same engine coolant temperature warm-up rates in vehicles with properly and improperly functioning thermostats. The ability to correctly diagnosis the condition of the thermostat is a function of the ratio of the radiator heat loss to the heater heat loss. The heat loss through the radiator must be greater than the maximum heat loss possible through the heater. In order to maximize the opportunity for a correct diagnosis, the vehicle must attain a minimum average vehicle speed by the time the pass/fail determination is made. The calibratable to check against for this condition is a minimum average vehicle speed threshold. This could be, for example, 10–20 mph. The internal bit set if the condition exists is a flag to show the diagnostic test was aborted due to the average vehicle speed being too low.

Separate pass and fail thresholds must be calibrated in order for an inconclusive error to be detected. The separate thresholds provide a means to account for poor separation between properly and improperly functioning thermostats, which may be caused, for example, by operation of an air conditioning system. The internal bit set if the inconclusive condition exists is a flag to show that the integrated error was lower than the pass threshold and higher than the fail threshold. It should be noted that this condition is different from an inconclusive test implied by a user dictated condition in a task manager, which can occur when the bit indicating that the thermostat rationality test is complete is set while neither the thermostat rationality test pass bit nor thermostat rationality test fail bit is set.

Additionally, in vehicles equipped with inlet-side thermostats, it is possible to pull the thermostat open at high engine speeds. The instantaneous engine speed is compared to a predetermined engine speed threshold during each execution of the test. If the threshold is exceeded, an aggressive driving timer is incremented. During the rationality diagnostic, if the test indicates that the integrated error is not above the pass threshold, the timer value is compared to the predetermined no fail aggressive threshold value. If the threshold is exceeded, a no fail aggressive flag is set and the trip neither passes or fails (implied inconclusive).

Preferably, the diagnostic feature stores a fault code and illuminates a malfunction indicator lamp after two failed trips occur.

Turning now to the drawing figures, a description of the present invention will be provided with reference to flow charts. Referring to FIG. 1, the methodology starts in block 10 and proceeds to decision block 12. In decision block 12 the methodology determines whether the fuel delivery mode is in a run mode. If not, the methodology returns to block 10. However, if the fuel delivery mode is in a run mode at decision block 12, the methodology continues to block 14.

In block 14, the methodology calculates the product of the mass and specific heat of the engine (including its solids and liquids) as corrected for the coolant temperature at the start-to-run transition. From block 14, the methodology continues to block 16. In block 16, the methodology sets the predicted engine coolant temperature equal to the actual engine coolant temperature.

From block 16, the methodology continues to block 18. In block 18 the methodology sets the predicted engine coolant temperature threshold where the diagnostic of the present invention will be run. This temperature threshold could be, for example, 120–175 degrees Fahrenheit which corresponds to the minimum of the predetermined maximum predicted coolant temperature or the actual starting coolant temperature plus a predetermined offset. From block 18, the methodology advances through connector A to block 20 of FIG. 2.

Figure 2:
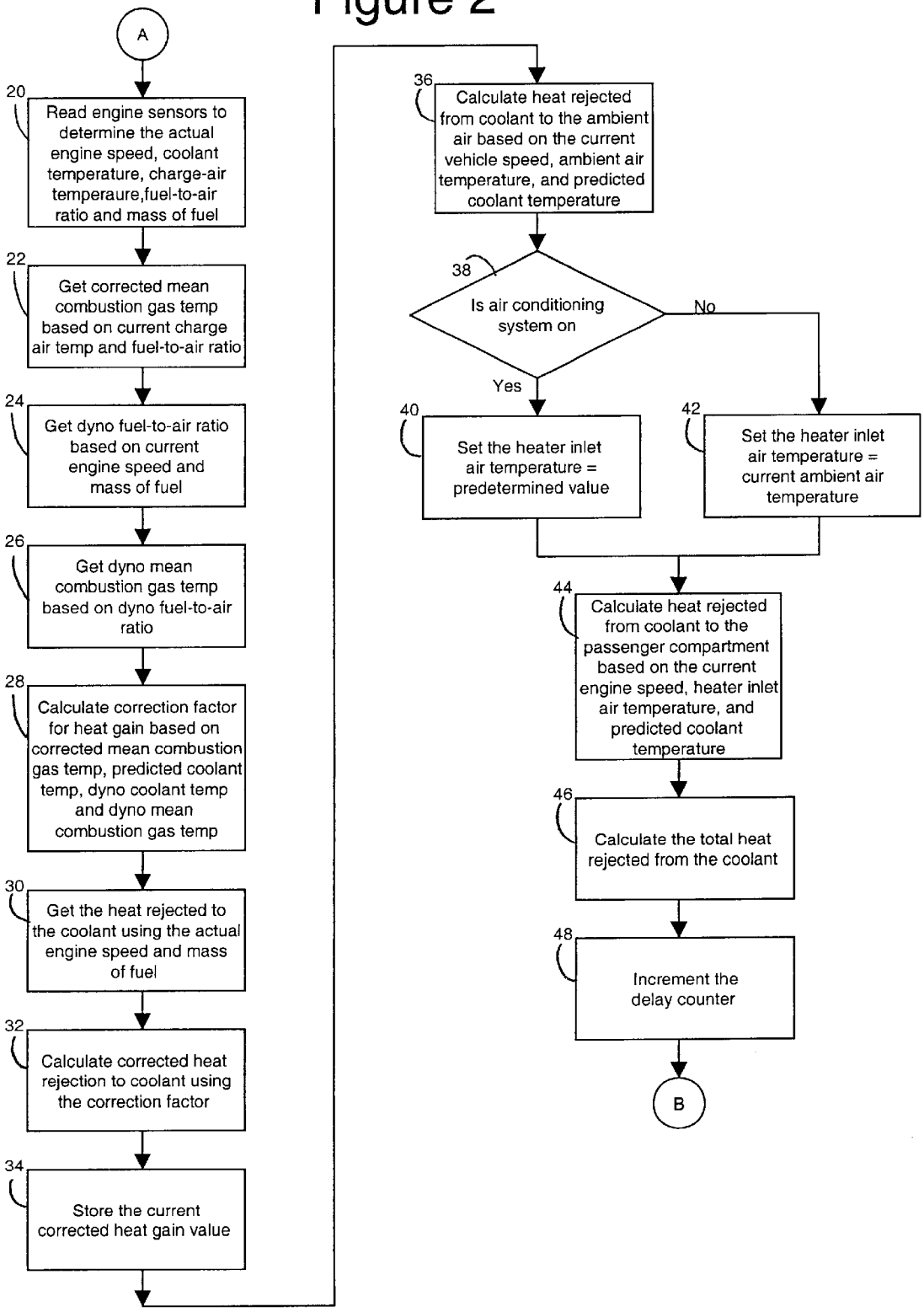
FIG. 2 is a flowchart depicting the calculation of the heat rejected to the coolant by the present invention.

Referring to FIG. 2, in block 20, the methodology reads the engine sensors to determine the current engine speed, coolant temperature, charge air temperature, fuel-to-air ratio and mass of fuel supplied for combustion. From block 20, the methodology continues to block 22. In block 22, the methodology determines the corrected, mean combustion gas temperature based on the charge air temperature and fuel-to-air ratio. From block 22 the methodology continues to block 24. In block 24, the methodology gets the dynamometer fuel-to-air ratio based on the current engine speed and the mass of the fuel. From block 24, the methodology continues to block 26. In block 26, the methodology gets the dynamometer, mean combustion gas temperature based on the dynamometer fuel-to-air ratio determined in block 24.

From block 26, the methodology continues to block 28. In block 28, the methodology calculates a correction factor for heat gain based on the corrected, mean combustion gas temperature from block 22, predicted coolant temperature from blocks 16 or 86, dynamometer coolant temperature, and dynamometer mean combustion gas temperature from block 26. From block 28, the methodology continues to block 30.

In block 30, the methodology determines the heat rejected to the engine coolant based on the engine speed and mass of the fuel. From block 30, the methodology continues to block 32. In block 32, the methodology corrects the heat rejection to the engine coolant determined in block 30 using the ambient correction factor from block 28. From block 32, the methodology continues to block 34. In block 34, the methodology stores the current corrected heat gain value.

After storing the current corrected heat gain value at block 34, the methodology continues to block 36. In block 36, the methodology calculates the heat rejected from the engine coolant to ambient air based on the current vehicle speed, the ambient air temperature, and the predicted engine coolant temperature (from blocks 16 or 86). From block 36, the methodology continues to decision block 38.

In decision block 38, the methodology determines if the vehicle air conditioning system is on. If the air conditioning system is on at decision block 38, the methodology advances to block 40. If the air conditioning system is not on at decision block 38, the methodology advances to block 42.

In block 40, the methodology sets the heater inlet air temperature value equal to a predetermined value, typically 40 degrees Fahrenheit. In block 42, the methodology sets the heater inlet air temperature value equal to the current ambient air temperature value. From blocks 40 and 42, the methodology continues to block 44.

In block 44, the methodology calculates the heat rejected from the engine coolant to the passenger compartment based on the current engine speed, the heater inlet air temperature (from either block 40 or 42), and the predicted coolant temperature (from blocks 16 or 86). From block 44, the methodology continues to block 46. In block 46, the methodology calculates the total heat rejected from the engine coolant by totaling the values determined at blocks 36 and 44.

From block 46, the methodology continues to block 48. In block 48, the methodology increments a delay counter. The delay counter accumulates the time since the start-to-run transition occurred. As described below, the delay counter is used to account for the time delay between when heat is released from the fuel until it increases the temperature of the coolant. After incrementing the delay counter at block 48, the methodology advances through connector B to decision block 50 of FIG. 3.

Figure 3:
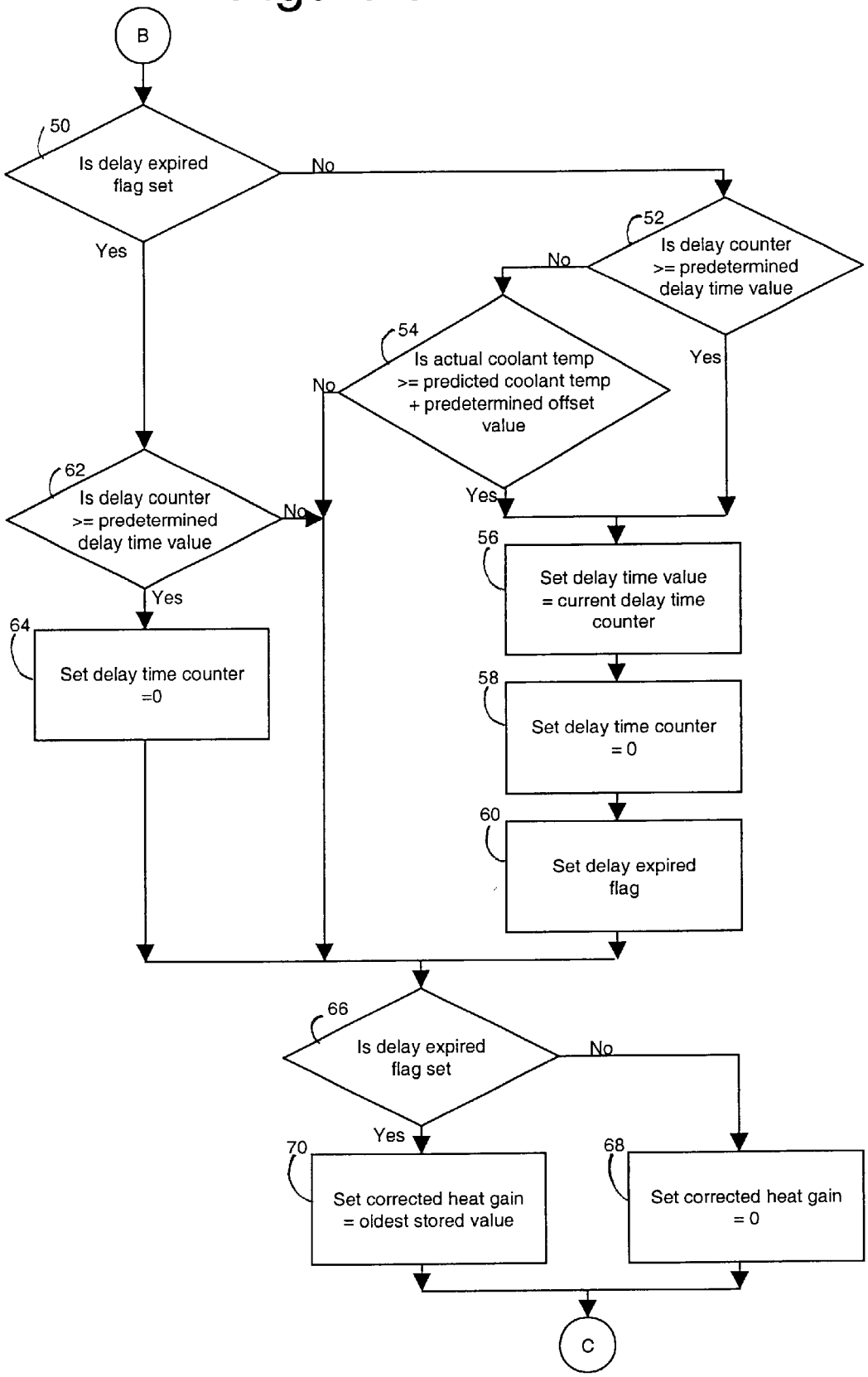
FIG. 3 is a flowchart depicting the heat gain delay methodology of the present invention.

Referring to FIG. 3, in decision block 50, the methodology determines if the delay expired flag is set. As described below, this flag is set when the delay counter incremented at block 48 is forced to zero. This occurs after a predetermined time has elapsed to ensure the coolant temperature will respond to heat input or if the actual coolant temperature is sufficiently high.

If the delay expired flag is not set at decision block 50, the methodology advances to decision block 52, In decision block 52, the methodology determines if the delay counter is greater than or equal to a predetermined delay time value. The predetermined delay time value preferably equals about 6–to about 14 seconds, if the delay counter is not greater than or equal to the predetermined delay time value at decision block 52, the methodology advances to decision block 54. On the other hand, if the delay counter is greater than or equal to the predetermined delay time value at decision block 52, the methodology advances to block 56.

In decision block 54, the methodology determines if the actual engine coolant temperature is greater than or equal to the predicted coolant temperature (from block 16) plus a predetermined offset value. The offset value preferably equals about 1 degree Fahrenheit which corresponds to the first indication that the actual coolant temperature is increasing based on the sensor scaling. If the actual coolant temperature is greater than or equal to the predicted coolant temperature plus the offset at decision block 54, the methodology advances to block 56. On the other hand, if the actual coolant temperature is not greater than or equal to the predicted coolant temperature plus the offset at decision block 54, the methodology advances to block 66.

In block 56, which is reached either from decision block 52 or decision block 54, the methodology sets the delay time value equal to the current value of the delay time counter (as incremented at block 48). From block 56, the methodology continues to block 58. In block 58, the methodology sets the delay time counter to zero. From block 58, the methodology continues to block 60. In block 60, the methodology sets the delay expired flag.

Referring again to decision block 50, if the delay expired flag is set, the methodology does not advance to decision block 52 as described above. Rather, the methodology advances to block 62.

In decision block 62, the methodology determines if the delay counter is greater than or equal to the delay time value determined in block 56.

If the delay counter value is greater than the predetermined delay time value at decision block 62, the methodology advance to block 64. If not the methodology advances to block 66.

In block 64, the methodology sets the delay time counter equal to zero. From block 64, the methodology continues to decision block 66. Decision block 66 is also reached from decision blocks 54 and 62 if the conditions are false, and block 60 after the methodology sets the delay expired flag.

In decision block 66, the methodology determines if the delay expired flag is set. If the delay expired flag is not set, the methodology advances to block 68. On the other hand, if the delay expired flag is set at decision block 66, the methodology advances to block 70.

In block 68, the methodology sets the corrected heat gain value equal to zero. In block 70, the methodology sets the corrected heat gain value equal to the oldest stored value. From blocks 68 and 70, the methodology continues through connector C to block 72 in FIG. 4.

Figure 4:
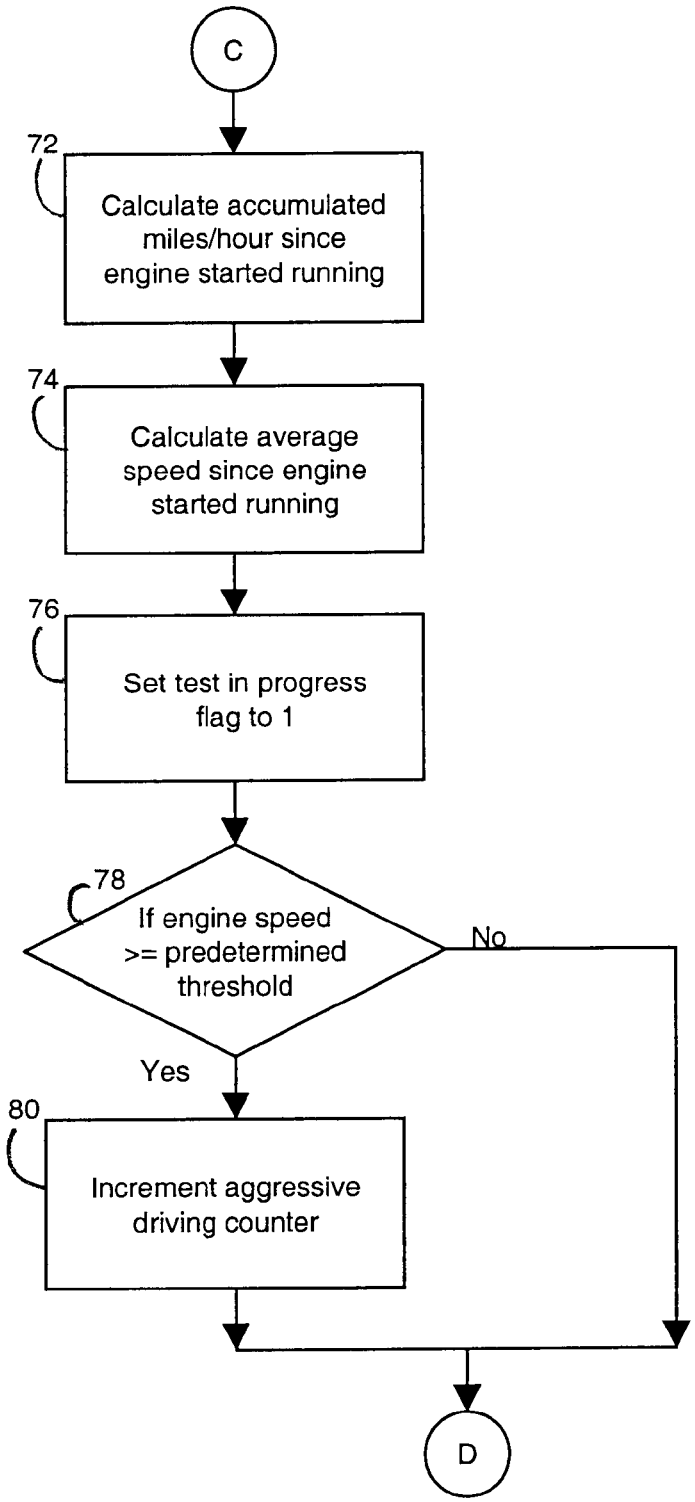
FIG. 4 is a flowchart depicting the average vehicle speed calculation and aggressive driving counter methodology of the present invention.

Referring to FIG. 4, in block 72, the methodology calculates the accumulated miles per hour since the start to run transfer. From block 72, the methodology continues to block 74. In block 74, the methodology calculates the average speed since the engine started running. From block 74, the methodology continues to block 76.

In block 76, the methodology sets the test in progress flag to 1. From block 76, the methodology continues to decision block 78. In decision block 78, the methodology determines if the engine speed is greater than a predetermined threshold. The predetermined threshold preferably equals 4000–5000 rpm which corresponds to a level at which the vehicle is deemed to be subjected to aggressive driving. Under aggressive driving circumstances, special diagnostics are used to test the reliability of the thermostat operation in the present diagnostic as described below.

If the engine speed is greater than or equal to the predetermined threshold at decision block 78, the methodology advances to block 80. In block 80, the methodology increments an aggressive driving counter. From block 80 and decision block 78, if the engine speed is not greater than or equal to the predetermined threshold, the methodology continues through connector D to decision block 82 of FIG. 5.

Figure 5:
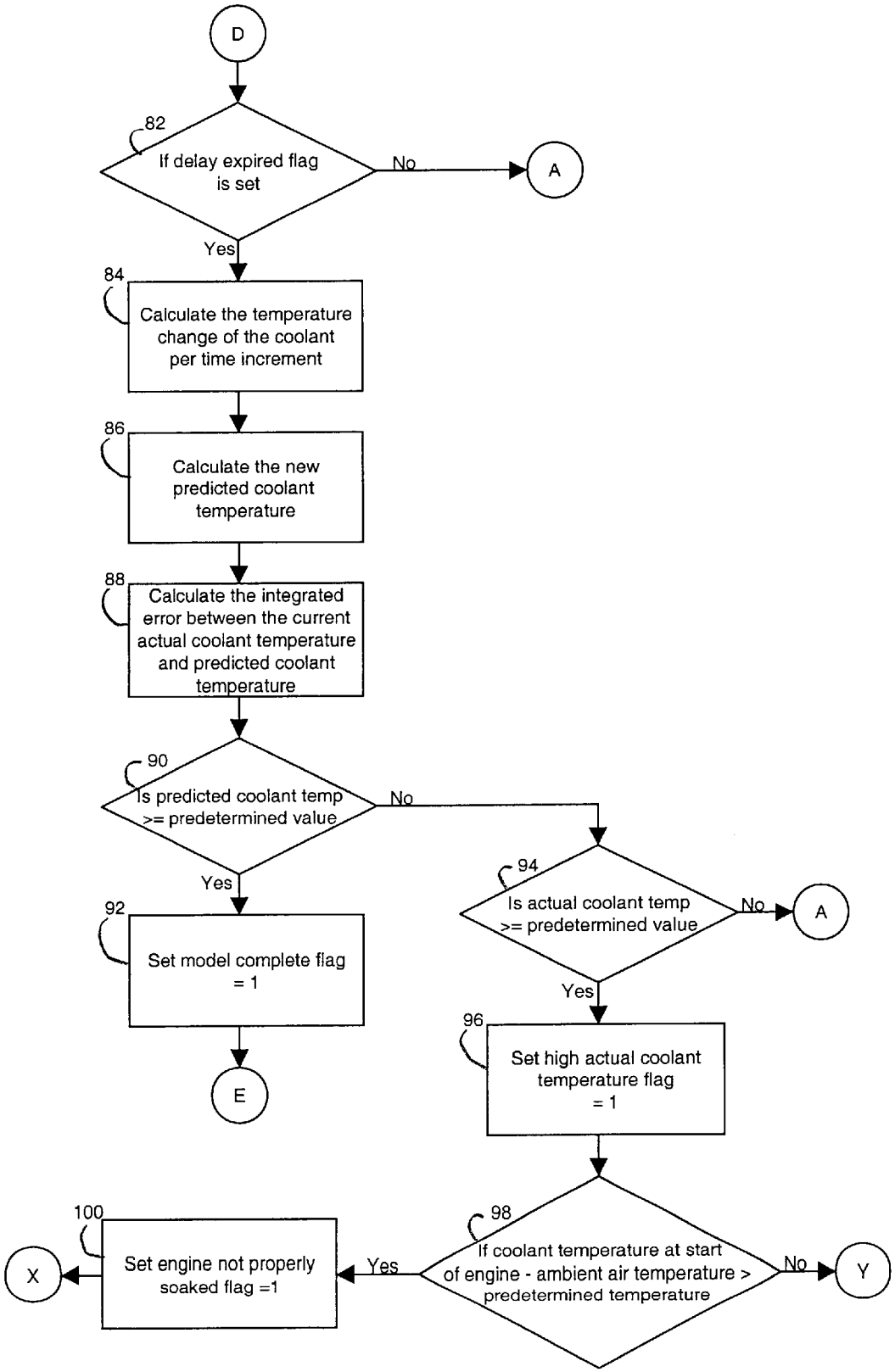
FIG. 5 is a flowchart depicting the predicted coolant temperature calculation and disable condition methodology of the present invention.

Referring to FIG. 5, in decision block 82, the methodology determines if the delay expired flag is set (from block 60). If not, the methodology advances through connector A to block 20 of FIG. 2. The methodology as described above is then repeated.

On the other hand, if the delay expired flag is set at decision block 82, the methodology advance to block 84. In block 84, the methodology calculates the temperature change of the engine coolant per time increment. From block 84, the methodology continues to block 86.

In block 86, the methodology calculates the new predicted coolant temperature value based on the temperature change of the coolant per time increment calculated at block 84. From block 86, the methodology continues to block 88. In block 88, the methodology calculates the integrated error between the current actual coolant temperature and the new predicted coolant temperature from block 86.

From block 88, the methodology continues to decision block 90. In decision block 90, the methodology determines if the new predicted coolant temperature is greater than or equal to a predetermined value. The predetermined value corresponds to the value determined in block 18. If the predicted coolant temperature value is greater than or equal to the predetermined value at decision block 90, the methodology advances to block 92. On the other hand, if the predicted coolant temperature value is not greater than or equal to the predetermined value at decision block 90, the methodology advances to decision block 94.

In block 92, the methodology sets the model complete flag equal to 1. After setting the model complete flag equal to 1 at block 92, the methodology continues through connector E to decision block 102 of FIG. 6. On the other hand, in decision block 94, the methodology determines if the actual coolant temperature is greater than or equal to the predetermined value. The predetermined value is preferably an engine coolant temperature pass threshold as prescribed by an industry or government prescribed standard, i.e., within 20 degrees Fahrenheit of the thermostat opening temperature.

If the actual coolant temperature is not greater than or equal to the predetermined value at decision block 94, the methodology advances through connector A to block 20 of FIG. 2. The methodology as described above is then repeated. On the other hand, if the actual coolant temperature is greater than or equal to the predetermined value at decision block 94, the methodology continues to block 96.

In block 96, the methodology sets a high actual coolant temperature flag equal to 1. After setting the high actual coolant temperature flag equal to 1 at block 96, the methodology continues to decision block 98. In decision block 98, the methodology determines if the coolant temperature at the time of the start of the engine minus the ambient air temperature is greater than a predetermined temperature. The predetermined temperature preferably equals 10 to 20 degrees Fahrenheit which corresponds to a temperature required to ensure a proper and reliable engine soak for running the present diagnostic.

If the coolant temperature at the time of the start of the engine minus the ambient air temperature is greater than the predetermined temperature, the methodology advances to block 100. In block 100, the methodology sets an engine not properly soaked flag equal to 1. After setting the engine not properly soaked flag equal to 1 at block 100, the methodology continues through connector X to block 130 in FIG. 8. On the other hand, if the coolant temperature at the time of the start of the engine minus the ambient air temperature is not greater than the predetermined temperature at decision block 98, the methodology does not advance to block 100. Rather, the methodology advances through connector Y to block 132 of FIG. 8.

Figure 6:
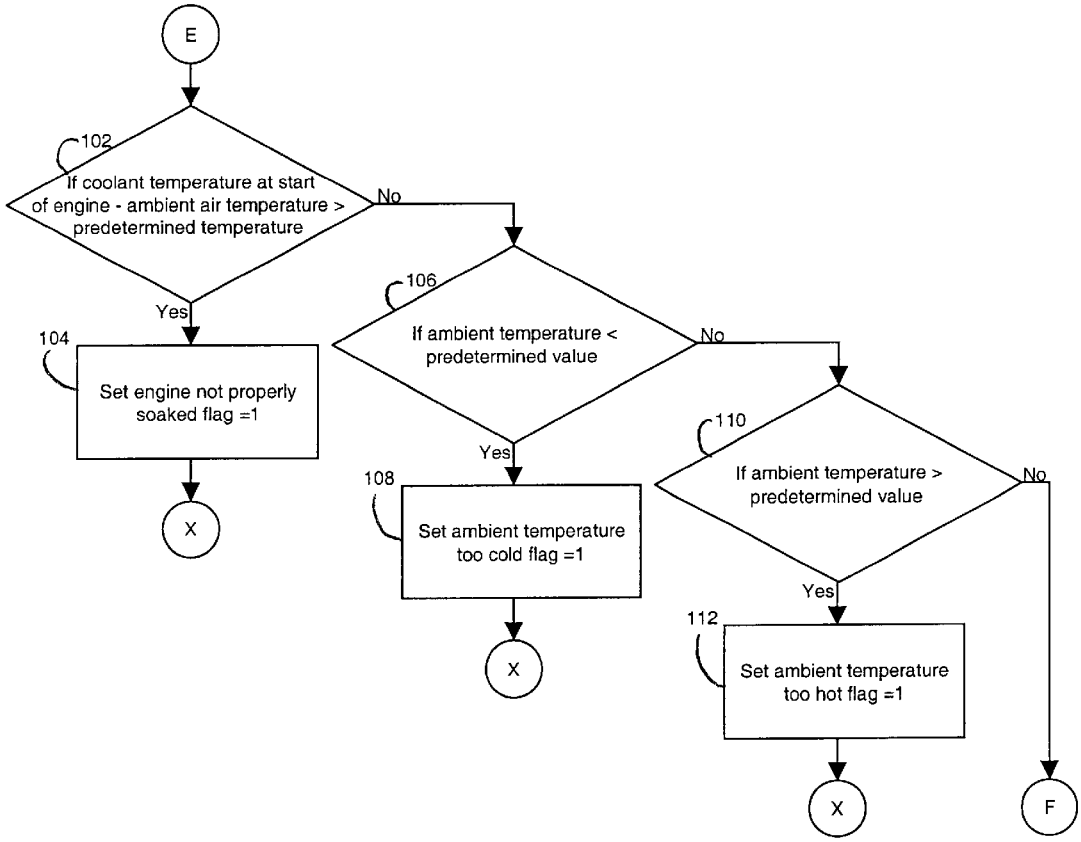
FIG. 6 is a flowchart further depicting the disable condition methodology of the present invention.

Turning now to FIG. 6, a description of the methodology is continued with reference to decision block 102. Decision block 102 is reached after the methodology sets the model complete flag equal to 1 in block 92 of FIG. 5. In decision block 102, the methodology determines if the coolant temperature at the time of the start of the engine minus the ambient air temperature is greater than a predetermined value. The predetermined value is preferably the same as the predetermined value used in decision block 98 of FIG. 5 and corresponds to a temperature required to ensure a proper and reliable engine soak for running the present diagnostic.

If the coolant temperature at the time of the start of the engine minus the ambient air temperature is greater than the predetermined value at decision block 102, the methodology advances to block 104. In block 104, the methodology sets the engine not properly soaked flag equal to 1. After setting the engine not properly soaked flag equal to 1 in block 104, the methodology continues through connector X to block 130 in FIG. 8.

On the other hand, if the coolant temperature at the time of the start of the engine minus the ambient air temperature is not greater than the predetermined value at decision block 102, the methodology advances to decision block 106. In decision block 106, the methodology determines if the ambient air temperature is less than a predetermined value. The predetermined value preferably equals about −10 to about 20 degrees Fahrenheit which corresponds to a temperature which is too cold to reliably run the present diagnostic.

If the ambient air temperature is less than the predetermined value at decision block 106, the methodology advances to block 108. In block 108, the methodology sets the ambient temperature too cold flag equal to 1. After setting the ambient air temperature too cold flag equal to 1 at block 108, the methodology continues through connector X to block 130 of FIG. 8.

On the other hand, if the ambient air temperature is not less than the predetermined value at decision block 106, the methodology advances to decision block 110. In decision block 110, the methodology determines if the ambient air temperature is greater than a predetermined value. The predetermined value preferably equals about 100 to about 110 degrees Fahrenheit which corresponds to a temperature which is too hot to reliably run the present diagnostic.

If the ambient air temperature is greater than the predetermined value at decision block 110, the methodology advances to block 112. In block 112, the methodology sets the ambient temperature too hot flag equal to 1. After setting the ambient air temperature too hot flag equal to 1 at block 112, the methodology continues through connector X to block 130 of FIG. 8. On the other hand, if the ambient air temperature is not greater than the predetermined value at decision block 110, the methodology advances through connector F to decision block 114 of FIG. 7.

Figure 7:
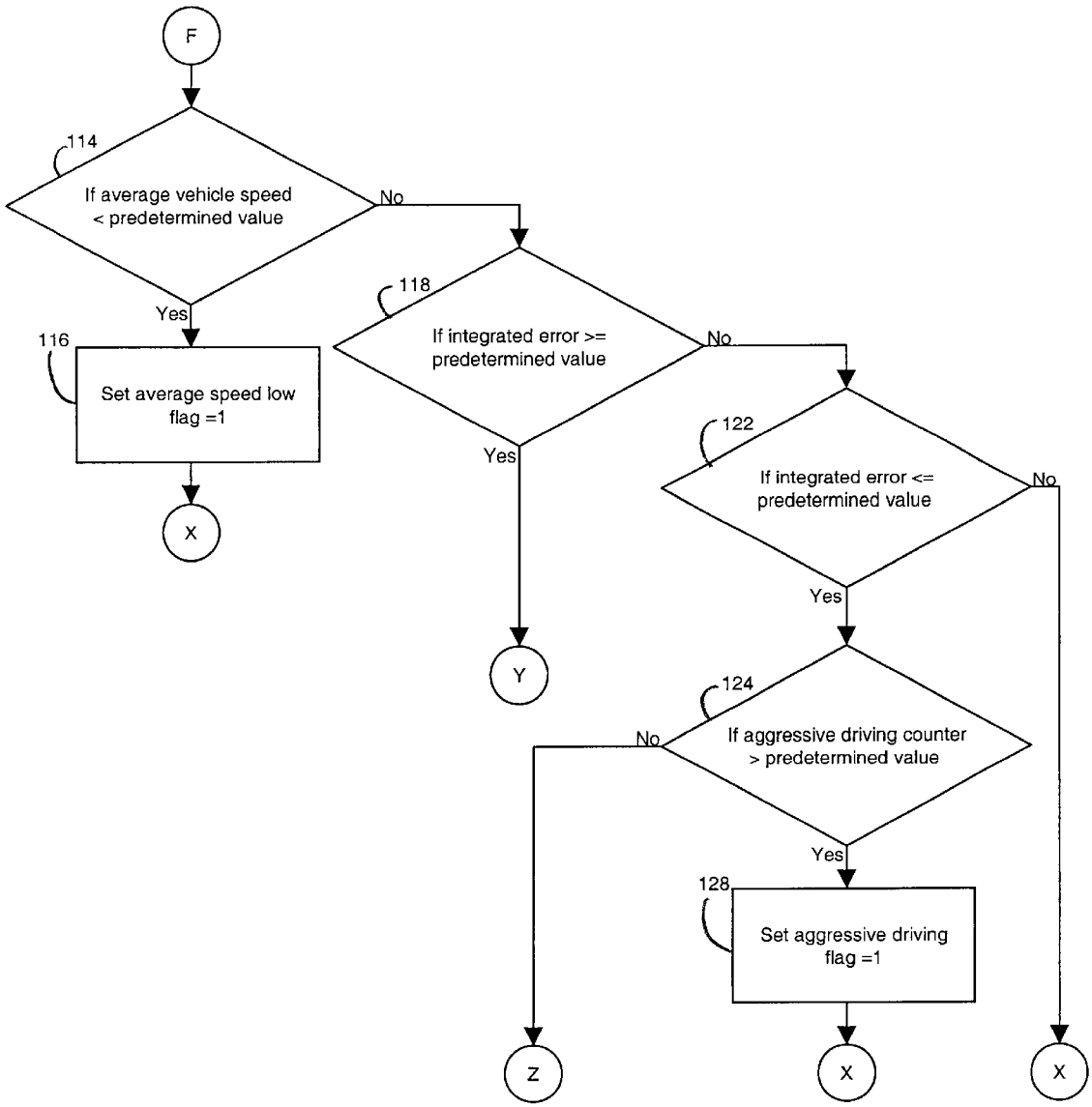
FIG. 7 is a flowchart further depicting the disable condition and diagnostic methodology of the present invention.

Referring now to FIG. 7, in decision block 114, the methodology determines if the average vehicle speed is less than a predetermined value. Preferably, the predetermined value is equal to about 10 to about 20 mph which corresponds to a minimum speed at which the present diagnostic is considered reliable. If the average vehicle speed is less than a predetermined value, the methodology advances to block 116. In block 116, the methodology sets an average speed too low flag equal to 1. After setting the average speed too low flag equal to 1 at block 116, the methodology continues through connector X to block 130 of FIG. 8.

On the other hand, if the average vehicle speed is not less than the predetermined value, the methodology advances to decision block 118. In decision block 118, the methodology determines if the integrated error (from block 88) is greater than or equal to a predetermined value. Preferably, the predetermined value corresponds to the lowest tolerance value which ensures proper operation of the thermostat and therefore reliability of the present diagnostic. If the integrated error is greater than or equal to the predetermined value at decision block 118, the methodology continues through connector Y to block 132 of FIG. 8.

On the other hand, if the integrated error is not greater than or equal to the predetermined value at decision block 118, the methodology advances to decision block 122. In decision block 122, the methodology determines if the integrated error value is less than or equal to a predetermined value. Preferably, the predetermined value is different from the predetermined value used in block 118 and corresponds to a highest tolerance value which ensures improper operation of the thermostat and therefore reliability of the present diagnostic.

Figure 8:
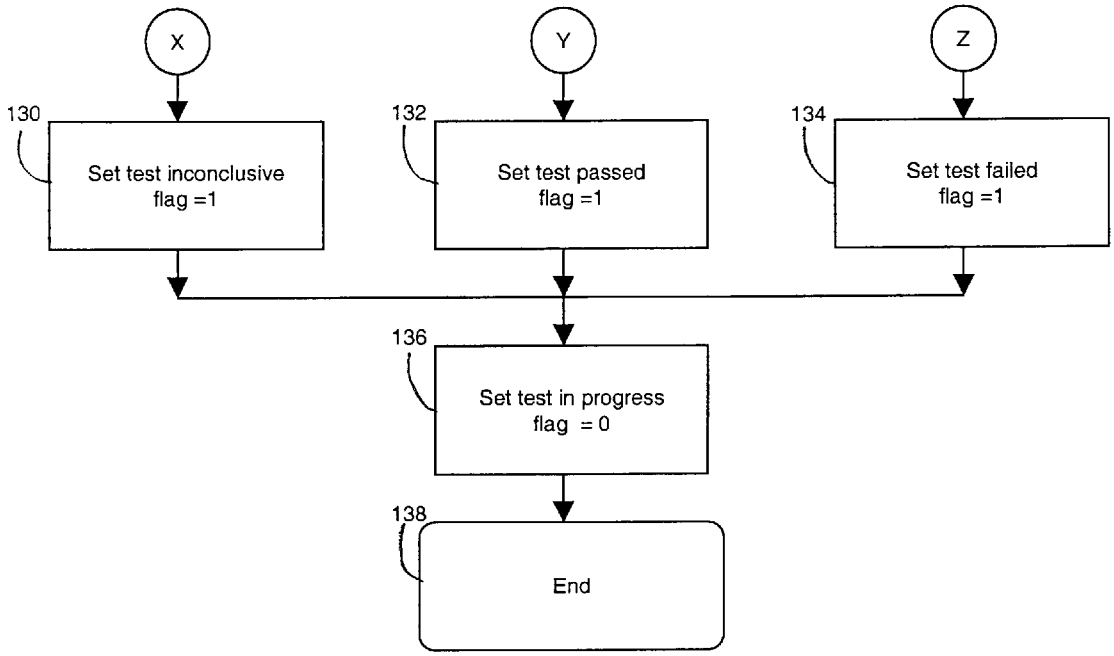
FIG. 8 is a flowchart depicting the diagnostic test completion methodology of the present invention.

If the integrated error value is not less than or equal to the predetermined value at decision block 122, the methodology advances through connector X to block 130 of FIG. 8. On the other hand, if the integrated error value is less than or equal to the predetermined value at decision block 122, the methodology advances to decision block 124. In decision block 124, the methodology determines if the aggressive driving counter (from block 80) is greater than a predetermined value. Preferably, the predetermined value corresponds to a level which indicates that the driving history is sufficiently aggressive to affect the apparent operation of the thermostat. If the aggressive driving counter is not greater than the predetermined value at decision block 124, the methodology continues through connector Z to block 134 of FIG. 8.

On the other hand, if the aggressive driving counter is greater than the predetermined value at decision block 124, the methodology advances to block 128. In block 128, the methodology sets an aggressive driving flag equal to 1. After setting the aggressive driving flag equal to 1 at block 128, the methodology continues through connector X to block 130 of FIG. 8.

Turning now to FIG. 8, a description of the methodology will continue with a reference to blocks 130, 132, 134 which are respectively reached as described above. In block 130, the methodology sets a test inconclusive flag equal to 1. This indicates that the proper function of the thermostat cannot be conclusively determined. In block 132, the methodology sets a test passed flag equal to 1. This indicates that the test deemed the thermostat to be functioning properly. In block 134, the methodology sets a test failed flag equal to 1. This indicates that the test deemed the thermostat to be functioning improperly.

From blocks 130, 132, and 134, the methodology continues to block 136. In block 136, the methodology sets the test in progress flag (from block 76) equal to zero. After setting the test in progress flag equal to zero in block 136, the methodology continues to block 138 and ends pending a subsequent execution thereof.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of testing a thermostat in a motor vehicle comprising:

determining a predicted engine coolant temperature for the motor vehicle;

integrating a difference between said predicted engine coolant temperature and an actual engine coolant temperature;

deeming said thermostat to be functioning properly if said integrated difference is greater than or equal to a first predetermined value; and deeming said thermostat to be functioning improperly if said integrated difference is less than or equal to a second predetermined value.

2. The method of claim 1 further comprising deeming said thermostat to be functioning inconclusively if said integrated error is less than said first predetermined value and greater than said second predetermined value.

3. The method of claim 1 further comprising deeming said thermostat to be functioning inconclusively if an aggressive driving sequence is detected.

4. The method of claim 1 further comprising deeming said thermostat to be functioning inconclusively if a slow driving sequence is detected.

5. The method of claim 1 further comprising deeming said thermostat to be functioning inconclusively if a hot ambient temperature threshold is exceeded.

6. The method of claim 1 further comprising deeming said thermostat to be functioning inconclusively if a cold ambient temperature threshold is exceeded.

7. The method of claim 1 further comprising deeming said thermostat to be functioning inconclusively if an engine not properly soaked condition is detected.

8. The method of claim 1 further comprising:

deeming said thermostat to be functioning properly notwithstanding said integrated difference if:

said predicted coolant temperature is greater than or equal to a predicted coolant temperature threshold value;

said actual coolant temperature is greater than or equal to an actual coolant temperature threshold value; and a coolant temperature at start-up minus an ambient air temperature is greater than a predetermined offset temperature threshold.

9. The method of claim 1 further comprising:

initially setting said predicted coolant temperature equal to said actual coolant temperature; and after a delay, calculating a new predicted coolant temperature.

10. The method of claim 9 wherein said step of calculating said new predicted coolant temperature further comprises:

calculating a heat gain to a coolant in an engine of said motor vehicle from the engine;

calculating a heat loss from said coolant to ambient air and a passenger compartment of the motor vehicle;

subtracting the heat lass from the heat gain to yield a corrected heat gain value; and adding the corrected heat gain value to an initial actual coolant temperature.

11. The method of claim 10 wherein said initial coolant temperature is obtained after a start to run transition of the motor vehicle.

12. The method of claim 10 wherein said step of calculating said heat gain further comprises:

obtaining a first heat rejected to the coolant value based on actual engine speed of an engine in said motor vehicle and a mass of fuel in said motor vehicle;

calculating a correction value based on corrected mean combustion gas temperature, said predicted coolant temperature, dynamometer coolant temperature, and dynamometer mean combustion gas temperature; and converting said first heat rejected to the coolant value to said heat gain using said correction value.

13. The method of claim 12 wherein:

said dynamometer mean combustion gas temperature is obtained based on dynamometer fuel-to-air ratio;

said dynamometer fuel-to-air ratio is obtained based on current engine speed and mass of fuel;

said corrected mean combustion gas temperature is obtained based on current fuel-to-air ratio; and said current engine speed, mass of fuel and fuel-to-air ratio are obtained using sensors in said motor vehicle.

14. The method of claim 10 wherein said step of calculating said heat loss from said coolant to ambient air further comprises a calculation based on current speed of said motor vehicle, ambient air temperature, and said predicted coolant temperature.

15. The method of claim 10 wherein said step of calculating said heat loss from said coolant to said passenger compartment of the motor vehicle further comprises a calculation based on current speed of said engine in said motor vehicle, temperature of inlet air at a heater of said motor vehicle, and said predicted coolant temperature.

16. The method of claim 15 wherein said temperature of inlet air at said heater equals a first predetermined value if an air conditioning system of said motor vehicle is on and a second predetermined value if said air conditioning system of said motor vehicle is off.

17. A method of testing a thermostat in a motor vehicle comprising:

determining a predicted engine coolant temperature for a coolant in the motor vehicle at a pre-selected time after start-up;

determining an actual engine coolant temperature for the coolant in the motor vehicle at said pre-selected time;

calculating an integrated error between the actual engine coolant temperature and the predicted engine coolant temperature;

deeming said thermostat to be functioning properly if said integrated error is greater than or equal to a first predetermined tolerance value; and deeming said thermostat to be functioning improperly if said integrated error is less than or equal to a second predetermined tolerance value.

18. The method of claim 17 wherein said pre-selected time is sufficient to ensure the actual engine coolant temperature is greater than a minimum temperature threshold value.

19. The method of claim 17 wherein step of determining said predicted engine coolant temperature further comprises combining a heat gain value accounting for engine heat rejection to the engine coolant with a heat loss value accounting for heat loss to ambient air and heat loss through a heater core of the motor vehicle, the heat loss accounting for an air conditioner off and on state.

20. The method of claim 19 wherein:

a value of said heat loss through said heater core is based on engine speed; and a value of said heat loss to ambient air is based on vehicle speed.

21. The method of claim 17 further comprising determining that the actual engine coolant temperature is not greater than ambient air temperature by more than a pre-selected soak threshold value to ensure that an adequate cold soak of the vehicle has occurred prior to step of calculating said integrated error between the actual engine coolant temperature the predicted engine coolant temperature.

22. The method of claim 17 further comprising determining that an ambient air temperature is greater than a minimum ambient air threshold temperature prior to said step of calculating an integrated error between the actual engine coolant temperature the predicted engine coolant temperature.

23. The method of claim 17 further comprising determining that an ambient air temperature is less than a maximum ambient air threshold temperature prior to said step of calculating an integrated error between the actual engine coolant temperature the predicted engine coolant temperature.

24. The method of claim 17 further comprising determining that the average vehicle speed is greater than a minimum average vehicle threshold speed prior to said step of calculating an integrated error between the actual engine coolant temperature the predicted engine coolant temperature.

* * * * *